United States Patent [19]

Bessard

[11] Patent Number: 4,566,492

[45] Date of Patent: Jan. 28, 1986

[54] FLUID DISTRIBUTING DEVICE, MORE ESPECIALLY FOR REMOTE CONTROL

[75] Inventor: Michel Bessard, Saint-Priest, France

[73] Assignee: Rexroth Sigma, Venissieux, France

[21] Appl. No.: 579,585

[22] Filed: Feb. 13, 1984

[30] Foreign Application Priority Data

Feb. 15, 1983 [FR] France ..... 83 02397

[51] Int. Cl.[4] ..... F15B 13/04

[52] U.S. Cl. ..... 137/636.1; 91/426; 137/596.1; 137/636.2

[58] Field of Search ..... 91/426; 137/596.1, 636.2, 137/636.1

[56] References Cited

U.S. PATENT DOCUMENTS

| | | | |
|---|---|---|---|
| 3,698,415 | 10/1972 | Forster et al. | 137/102 |
| 3,766,944 | 10/1973 | Distler | 137/636.2 X |
| 4,184,512 | 1/1980 | Pignolet | 137/596 |
| 4,341,243 | 7/1982 | Melocik | 137/596.2 X |
| 4,342,335 | 8/1982 | Reinicker et al. | 137/636.2 |
| 4,461,320 | 7/1984 | Barbagli | 137/596.1 X |

FOREIGN PATENT DOCUMENTS

| | | | |
|---|---|---|---|
| 1494400 | 12/1977 | United Kingdom | 137/596 |

*Primary Examiner*—Gerald A. Michalsky
*Attorney, Agent, or Firm*—Larson and Taylor

[57] ABSTRACT

The fluid distributing device, more especially for remote control, comprises a body (2) having bores (3) with parallel axes in which are slidably mounted slide valves (4) associated in pairs and controlled by push-rods (5) actuated by an oscillating cam (6). Each slide valve bore (3) has a groove (8) connected to the pressurized fluid intake, each slide valve being combined with a chamber (9) limited by at least one transverse annular surface (b) of the slide valve and connected to the reservoir by a constriction. It comprises return devices (R) for each push-rod (5) adapted to maintain a first push-rod in abutment against the cam (6) when this latter tends to move away from the push-rod and each slide valve comprises, on its periphery, towards its end (15) remote from the push-rod, a recess (g) whose arrangement and length are such that before the end of the complete movement of the slide valve (4) when it is driven by the first push-rod, the recess establishes a connection between the pressurized fluid intake (8,P) and the chamber (9), the whole being such that there is a rise in pressure of the fluid in this chamber (9) which causes locking of the slide valve (4) and of the first push-rod (5) in the high position.

11 Claims, 4 Drawing Figures

FLUID DISTRIBUTING DEVICE, MORE ESPECIALLY FOR REMOTE CONTROL

The invention relates to a fluid distributing device, more especially for remote control, of the kind comprising a body having bores with parallel axes in which are mounted slide valves associated in pairs, more especially symmetrically with respect to the axis of the body, these slide valves being controlled by push-rods actuated by an oscillating cam or similar device for establishing the desired communications between a pressurized fluid intake, a low pressure fluid reservoir, and an outlet orifice towards a user device, each slide valve bore comprising a groove connected to the pressurized fluid intake, each slide valve being combined with a chamber defined by at least one annular transverse surface of the slide valve and connected to the reservoir by a constriction. The invention relates more particularly, but not exclusively, to distributing devices of this kind used on public works vehicles.

It is known to adapt a fluid distributor of the kind in question so that the control may be blocked in a working position determined beforehand for a given function. Such locking allows the user of the fluid distributing device to let go of the lever acting on the oscillating cam, without the function being interrupted; meantime, the user may carry out another manoeuvre.

Such a fluid distributing device is known for example from U.S. Pat. No. 4,461,320 (Barbagli). However, this known device presents the disadvantage that, because of the very fact of its construction, the push-rod which is situated opposite the part of the cam which tends to move away is only subjected to a rising force for moving it into contact with the cam when the cam has been brought and maintained in an endmost inclined position causing another push-rod opposite the preceding one to be pushed in to the maximum. The fact that the first named push-rod comes suddenly into abutment against the cam generates shocks likely to inconvenience the user and in the long run to damage the apparatus.

Furthermore, such an arrangement makes two opposite push-rods dependent on each other since the hydraulic pressure required for the upward movement of one is supplied following the downward movement of the other. The result is that the reliability and safety of the device are not optimum. Finally, the arrangement in question requires the machining of numerous connecting channels, which singularly complicates the structure and increases the manufacturing cost thereof.

The invention has essentially the aim to overcome these drawbacks as much as possible and to propose a distributing device which better satisfies the different requirements of practice and which, in particular, is smoother in operation, which is more reliable and more sure and which is of a simpler and less costly structure to manufacture.

According to the invention, a fluid distributing device of the above-mentioned kind is characterized by the fact that it comprises return means for each push-rod adapted to maintain a first push-rod in permanent abutment against the cam when this latter tends to move away from said push-rod during the movement driving in a second associated push-rod, the slide valve corresponding to the first push-rod being driven thereby in its movement, and by the fact that each slide valve comprises, on its periphery, on its end remote from the push-rod, a recess whose arrangement and length are such that before the end of the complete movement of the slide valve when it is driven by the first push-rod, said recess establishes a connection between the pressurized fluid intake and said chamber, the whole being such that there is a rising pressure of the fluid in this chamber which ensures locking of the slide valve and of the first push-rod in the top position and, consequently locking of the other push-rod and of the corresponding slide valve in the low position.

The return means for each push-rod may comprise resilient return means, formed more especially by a spring bearing at one end against the body and at the other against the push-rod, abutment surfaces being provided between the push-rod and the slide valve so as to allow the slide valve to be driven by the push-rod.

The recess provided at the periphery of the slide valve may be formed by a peripheral clearance forming an annular groove.

The slide valve may be a regulating slide valve, the driving-in of which is controlled from the push-rod through an adjusting spring so that the pressure of the fluid, at the outlet orifice may be regulated. In this case, advantageously, the output orifice is provided in the axis of the bore of the regulating slide valve, which comprises an axial channel opening at one end towards said outlet orifice, said chamber being provided in the body of the distributor and being situated in the direction of the axis of the bore between the zone of this bore where the axial channel emerges and the groove connected to the pressure inlet.

The slide valve may be a simple distributing slide valve controlled directly by the push-rod; the chamber is then provided in the distributor body at the end of the slide valve opposite the push-rod.

Advantageously, all the fluid pressure intake, reservoir return and outlet orifices may be provided in the same face of the distributor, generally the face opposite that adjacent the cam.

Locking is provided so that it is possible, for the user, to overcome the locking pressure in the case of an emergency stop or for safety reasons, by acting on the normal control and by exerting a reaonsable force.

An automatic control may be further provided for unlocking, for example when a movement is finished, by means of an end of travel contact.

This unlocking control may be effected by establishing a connection, more especially through an electromagnetic valve, between the chambers corresponding to the two associated slide valves.

The invention will be better understood from the following description of particular but non limiting embodiments, shown in the accompanying drawings.

FIG. 1 of these drawings is a simplified representation of a distributing device in accordance with the invention comprising regulating slide valves.

Figure 1:
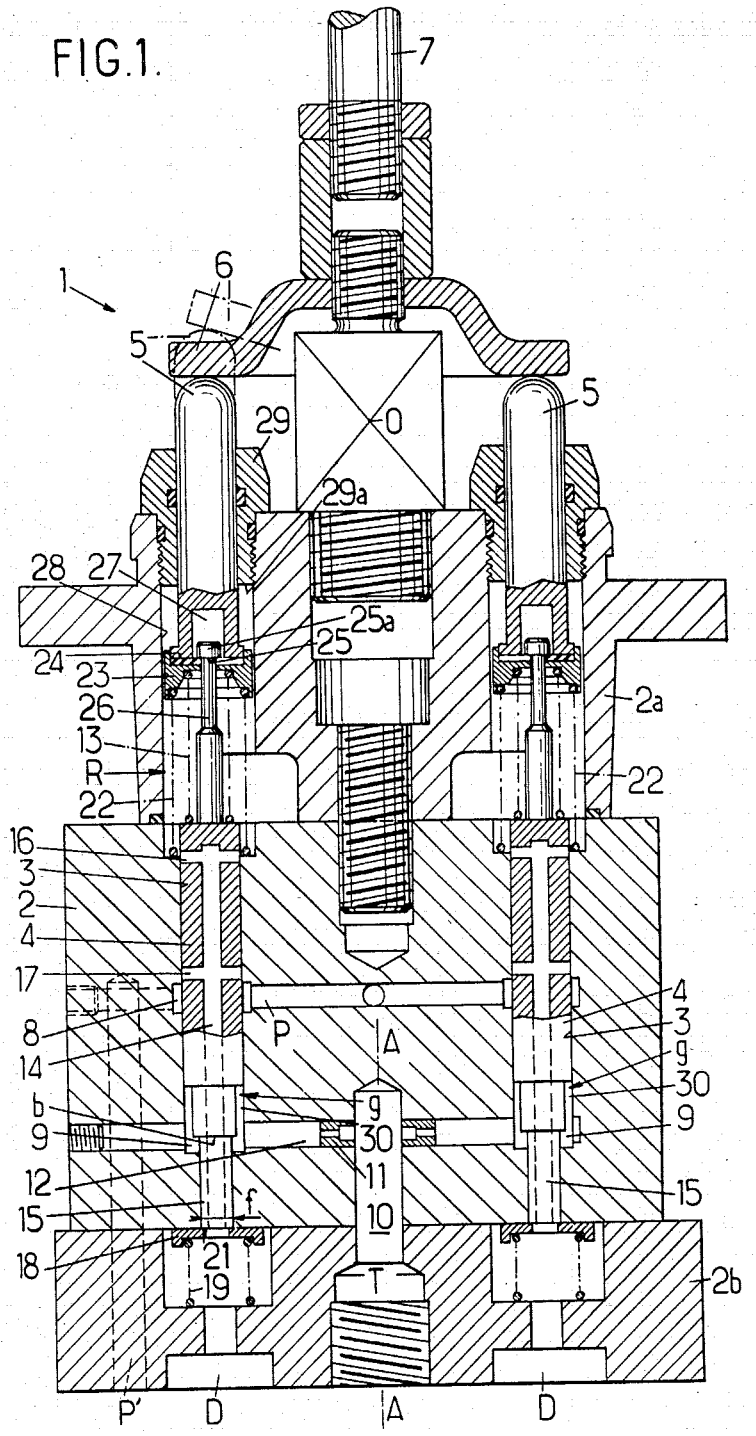
Figure 4:
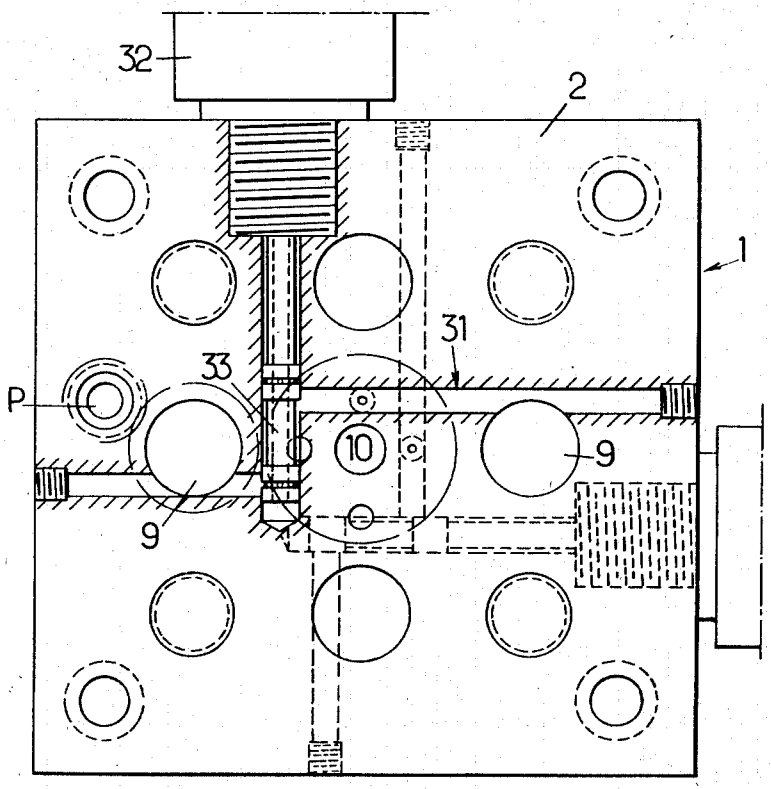

FIG. 4, finally, is a simplified bottom view, with respect to FIG. 1, showing the automatic unlocking system.

With reference to FIG. 1, a fluid distributing device 1 may be seen formed by a hydraulic manipulator, more especially for remote control. This device comprises a body 2 having bores 3 with parallel axes in which are mounted slide valves 4 associated in pairs, symmetrically with respect to the axis A—A of the body. Generally two or four bores, as well as two or four corresponding slide valves are provided in body 2, diametrically opposed in twos.

Each slide valve 4 is controlled by a push-rod 5 actuated by an oscillating cam 6 or similar device. Cam 6 forms a sort of plate fixed to a control lever 7 pivotally mounted about point O. Each slide valve 4 is adapted to establish, by moving in bore 3, the desired communications between a pressurized fluid intake P situated in body 2, a low pressure fluid reservoir (not shown) connected to the zones designated by T and an outlet orifice D, corresponding to each bore 3, towards a user device (not shown) such as a hydraulic cylinder.

Each bore 3 comprises an annular groove 8 connected to the pressurized fluid intake P. Each slide valve 3 is combined with a chamber 9 defined by at least one transverse annular surface b of the slide valves. This chamber 9 is connected to a duct 10 leading to the reservoir through a constriction e formed advantageously by a jet 11 with calibrated nozzle mounted in a duct 12 connecting chamber 9 to duct 10.

In the embodiment of FIG. 1, each slide valve 4 is a regulating slide valve whose inward movement into bore 3 is controlled from push-rod 5 through an adjusting spring 13.

In the embodiment shown in FIG. 1, the outlet or discharge orifice D associated with bore 3 is provided in the axis of this bore; the slide valve 4 comprises an axial channel 14 emerging at its end 15 turned towards orifice D. Radial channels 16,17 are provided at appropriate locations, along the axial direction, for establishing the desired connections during movement of the slide valve 4.

End 15, when the slide valve 4 is driven in, comes into abutment against a washer 18 in abutment against body 2 and pushes this washer back against a spring 19 house in a cylindrical space 20 communicating axially with the outlet orifice D, and provided towards said end 15.

The end zone 15 of slide valve 4 has a diameter f smaller than that of bore 3, the diameter of bore 3 is equal (except for the operating clearance) to that of the major part of slide valve 4. The annular transverse surface b is formed by the shoulder marking the transition between the end zone 15 and the rest of the slide valve. Chamber 9 is provided in the body of the distributor and is situated, in the direction of the axis of the bore, between zone 21 of this bore where the axial channel 14 emerges and groove 8 connected to the pressure intake P.

The distributing device 1 comprises return means R for each push-rod 5 adapted for maintaining a first push-rod against cam 6 when this latter tends to move away from said push-rod during the driving-in movement of a second diametrically opposite push-rod. According to the representation of FIG. 1, that means that the first push-rod 5 is held in abutment against cam 6 when the region of this latter, in abutment against the push-rod, moves upwardly.

These return means R comprises advantageously resilient return means formed by a spring 22 bearing at one end against body 2 and at its other end against push-rod 5, more especially through a cup 23. Abutment surfaces 24;25 are provided between push-rod 5 and slide valve 4 so as to allow the slide valve to be driven by the push-rod 5, under the action of spring 13, in an upward movement according to the representation of FIG. 1. More precisely, the abutment surface 24 of push-rod 5 is obtained by means of two half washers separated along a diameter, inserted between cup 23 and a base of push-rod 5. The abutment surface 25 is formed by a transverse shoulder of the head 25*a* of a plunger 26 integral with the slide valve 4. Head 25*a* is situated in a blind bore 27 of push-rod 5, the axial length of this blind bore 27 allowing an upward range of movement, with respect to the push-rod, of head 25*a*. Cup 23 and push-rod 5 slide in a bore 28 provided in an added upper part 2*a* of the distributor body. Bore 28 is closed by a plug 29, screwed into the threaded end of bore 28 and whose inner transverse face 29*a* serves as an end of travel stop for push-rod 5.

Each slide valve 4 comprises, on its periphery, towards its end 15 remote from the push-rod, a recess g advantageously formed by a peripheral clearance forming an annular groove 30 situated between the endmost zone 15 of slide valve 4 and the rest of the slide valve. The arrangement of this groove 30 along the axis of the slide valve 4, and its length are such that, before the end of a complete movement of slide valve 4 when it is driven (upwardly according to the representation of FIG. 1) by push-rod 5, said recess or groove 30 establishes a connection between the pressurized fluid intake groove 8 and chamber 9. Thus there is a rise in pressure of the fluid in this chamber, which ensures hydraulic locking of the slide valve 4 and of the push-rod 5 in the top position and consequently locking of the push-rod and of the diametrically opposite corresponding slide valve in the low position.

The abutment surface 29A of plug 29 is situated so that the push-rod 5 may effect a sufficiently long travel for groove 30 to communicate with groove 8.

The permanent flow which is established through jet 11 creates a pressure drop ensuring the maintenance of sufficient pressure in chamber 9 for hydraulic locking.

This locking is provided so that it is possible, for the user, to overcome the hydraulic locking force in the case of any emergency stop or for safety reasons by exerting a reasonable force on lever 7.

An automatic unlocking control may be provided when a lifting movement controlled by the user device (not shown) connected to the outlet orifice D is finished.

As can be seen in FIG. 4, this unlocking control comprises an assembly 31 of ducts for connecting between the two chambers 9 of the diametrically opposite slide valves 4. The passage of the fluid through this duct assembly 31 is controlled by an electromagnetic valve 32 whose slide valve 33 is housed in a duct section of assembly 31. When communication between the two diametrically opposite chambers 9 is cut off by slide valve 33, the hydraulic locking may take place. When communication between the two opposite chambers 9 is established by slide valve 33, the pressures in the unlocking chambers are equalized, more especially because spring 19 compressed by the pushed-in slide valve 4 may push this slide valve 4 back and so cam 6 towards the neutral position.

The control of the electomagnetic valve 32 may be provided by an end of travel contact (not shown) controlling the unlocking at the end of movement, for example of a hydraulic cylinder connected to orifice D, or to a hydraulic control distributor driven by the pressure from orifice D, through movement of slide valve 33.

The operation of the distributing device shown in FIG. 1 is as follows.

At rest, the control lever 7 is held in the neutral position by spring 19.

When the lever is inclined in one direction, the corresponding push-rod 5 is actuated by cam 6 including the corresponding adjusting spring 13 which pushes the regulating slide valve 4 downwards. At the beginning of the stroke of slide valve 4, the connecting is suppressed which existed in the neutral position between the out-going orifice D and the exhaust T; since the driving in of slide valve 4 continues, the connection between the pressure intake groove 8 and the outgoing orifice D is established through the radial channel 17 and the axial channel 14.

Simultaneously, the other push-rod 5, diametrically opposite the one which is driven in, is held in contact against the cam 6 by the effect of the corresponding spring 22. The slide valve 4 and plunger 26 rise gradually until the recess g (groove 30) establishes communication between groove 8 and the corresponding chamber 9. The resulting flow of fluid into chamber 9 through jet 11 creates a loss of pressure and an increase of pressure in chamber 9. This pressure causes slide valve 4 to rise and also plunger 26 which will come into abutment against the bottom of the blind bore 27. The corresponding push-rod 5 rises in its turn and drives cam 6 and lever 7.

The hydraulic locking is effected. The user may let go of lever 7 without the distribution function being interrupted.

At the end of the operation, as explained previously, the electromagnetic valve 32 establishes, by means of its slide valve 33, communication between the diametrically opposite chambers 9 and equalization of the pressures in these chambers 9 causes unlocking and lever 7 to return to position 9, particularly because of the action of that one of the springs 19 which is compressed.

Jets 11, which establish communication with the reservoir, cause decompression of chambers 9.

In the case of an emergency stop, and for safety's sake, the user may at any time come back to the neutral position by acting on lever 7 with a reasonable force.

As can be seen in FIGS. 1 and 4, all the pressurized fluid intake, reservoir return and outgoing orifices are provided advantageously on the same face of distributor 1; in the representation of FIG. 1, it is a question of the lower face remote from cam 6.

The lay-out of the ducts in body 2 is particularly simple, particularly because of the situation of the outgoing orifice D in the axial extension of channel 14.

Generally, body 2 comprises a lower added part **2*b*, as can be seen in FIG. 1. Separation between part 2*b* and body 2 is effected advantageously at the level of the endmost surface of the part 15 of slide valve 4 in the neutral position. Thus, bore 3 in which the major part of slide valve 4 slides and the bore in which the endmost part 15 slides are provided in the same piece 2** and their concentricity may be obtained under good conditions during manufacture.

Figure 2:
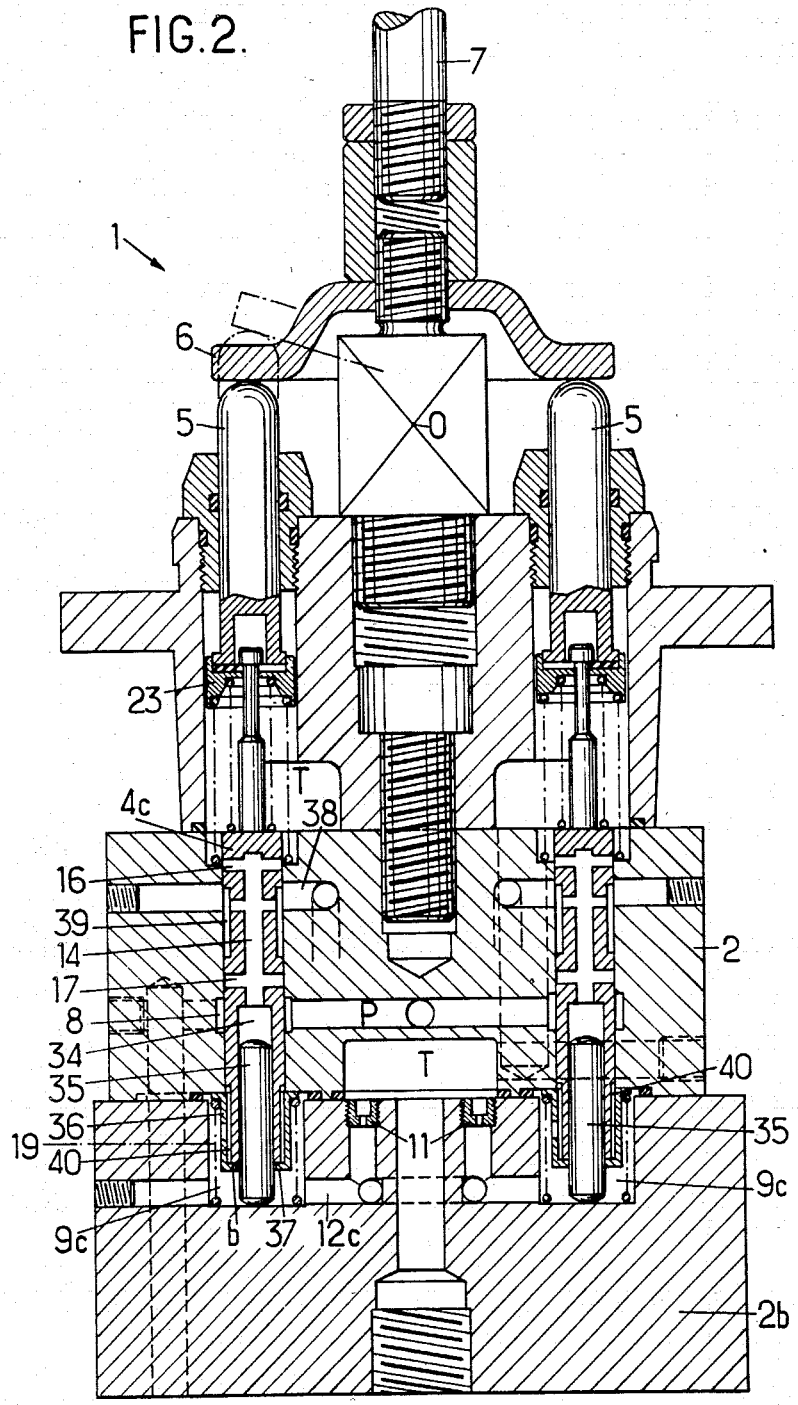
FIG. 2 shows a variant of the distributor of FIG. 1.

FIG. 2 illustrates a variant in which the distributing device is equipped with regulating slide valves. The numerical references used in FIG. 1 are used again, accompanied possibly by the letter c in FIG. 2, to designate identical elements or elements playing similar roles. The description of these elements will not be given again in detail.

The differences of construction between FIG. 2 and FIG. 1 will be essentially noted.

Chambers **9*c* are provided at the end of bore 3 in which slide valve 4*c* slides. The transverse surface b partly limiting chamber 9*c* is formed by the front endmost annular surface of slide valve 4C. This slide valve comprises an axial channel 14 which is transformed, in the zone turned towards chamber 9*c*, into a cylindrical housing 34 of larger diameter, which opens towards chambers 9*c*. A needle 35 is slidingly and sealingly mounted in this housing 34; this cylindrical needle 35 bears, at one end, against the bottom of chamber 9*c*. The two ends of needle 35** are rounded.

Spring 19 is compressed between the bottom of chamber **9*c* and an outwardly turned annular flange of a socket 36 mounted on the end zone of slide valve 4*c*; socket 36 comprises an inner flange 37 bearing against the transverse surface b of slide valve 4*c***.

Whereas in FIG. 1 the outgoing fluid intended for a user device, for example a hydraulic cylinder, follows the axis of slide valve 4, in the construction of FIG. 2, this outgoing fluid leaves from a radial duct 38 provided in body 2 between groove 8 and the bearing zone of spring 22. Slide valve **4*c* comprises, on its periphery, between the radial channels 16 and 17, an annular groove 39 connected to the axial channel 14 and intended to establish communication between the pressurized fluid intake groove 8 and the outgoing duct 38**.

Recess g is formed by a peripheral clearance 40 provided at the end of slide valve **4*c***.

The outgoing duct 38 is connected by a bore, not shown, to the lower face of part **2*b***.

The operation of the distributing device of FIG. 2 is similar to that of FIG. 1.

When a push-rod 5 is driven in, the diametrically opposite push-rod follows the cam while rising and driving the corresponding slide valve **4*c***.

When the recess g, formed by the peripheral clearance 40, arrives at the level of pressurized fluid intake groove 8, chamber **9*c* receives pressurized fluid and the pressure loss through the jet 11 causes the pressure rise in this chamber. Needle 35 then rises again in its housing 34 under the effect of the pressure and comes into abutment against the bottom of this housing. Plunger 4*c* also rises under the effect of the pressure and head 25*a* comes into abutment against the bottom of bore 27**.

Hydraulic locking is obtained under the same conditions as those mentioned above.

Unlocking may be provided by establishing communication between chambers **9*c* under similar conditions to those explained with reference to FIG. 4**.

It should be noted that although springs 22 form simple and efficient means for returning the push-rods 5 so as to hold them in abutment against cam 6 when this latter tends to move away from them, other return means could be provided, for example a mechanical type connection between cam 6 and push-rod 5.

Figure 3:
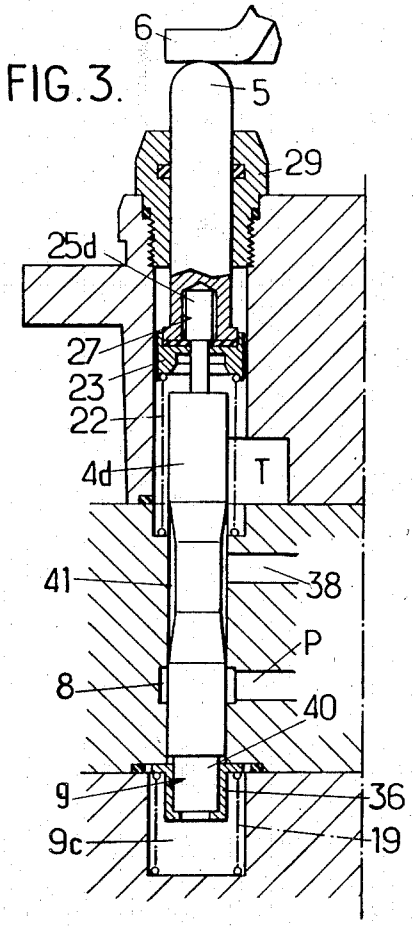
FIG. 3 is a partial schematic representation of a distributor according to the invention comprising distributing slide valves.

FIG. 3 shows a variant of the distributing device in which slide valve **4*d* is a simple distributing slide valve which is driven in under the direct mechanical thrust of push-rod 5; for that, the head 25*d* of the plunger connected to slide valve 4*d* is in abutment against the bottom of the blind bore 27 of push-rod 5. We find again, at the end of the slide valve 4*d* distant from push-rod 5, a chamber 9*c* such as shown in FIG. 2 and which has just been described. Recess g is still formed by an annular peripheral clearance 40 provided at the end of slide valve 4*d*** whose section is solid.

This distributing slide valve **4*d* comprises, in its central zone, a groove with tapering walls 41 providing the desired communications during movement of slide valve 4***d*.

We find again of course spring 22 provided between body 2 and the cup 23 of push-rod 5.

The operation is similar to that described above.

When a push-rod 5 is driven in by the cam 6, the diametrically opposite push-rod remains in abutment against the cam under the effect of spring 22 and raises slide valve 4*d*. For sufficient upward travel of this slide valve 4*d*, groove 41 enters into communication with the groove 8 for intake of pressurized fluid which is thus admitted into chamber 9*c*. Hydraulic locking occurs as explained above.

Unlocking may be obtained automatically under the same conditions as those explained with reference to FIGS. 1 and 4.

Other forms of slide valves with differential sections could be envisaged.

It should be noted that spring 22 provides permanent contact between push-rod 5 and cam 6 and contributes to preventing shocks between these two parts. Spring 19 ensures maintenance in the neutral position when the manipulator is unlocked.

I claim:

1. A fluid distributing device for remote control, comprising a body having bores with parallel axes in which are slidably mounted slide valves associated in pairs symmetrically with respect to an axis of the body, these slide valves being controlled by push-rods actuated by an oscillating cam so as to establish desired communications between a pressurized fluid intake, a low pressure fluid reservoir and an outgoing orifice towards a user device, each slide valve bore comprising a groove connected to the pressurized fluid intake, each slide valve being combined with a chamber limited by at least one transverse annular surface of the slide valve and connected to the reservoir by a constriction, wherein the device comprises return means (R) for each push-rod (5), adapted for maintaining a first push-rod in permanent abutment against the cam (6) when this cam tends to move away from said push-rod during a driving in movement of a second associated push-rod, the slide valve (4) corresponding to the first push-rod being driven by this first push-rod in its movement, and wherein each slide valve comprises, on its periphery, towards an end (15) remote from the push-rod, a recess (g) whose arrangement and length are such that before an end of a complete movement of the slide valve (4) when this slide valve is driven by the first push-rod, said recess establishes a connection between the pressurized fluid intake (P,8) and said chamber (9), such that there is a pressure rise of the fluid in this chamber (9) which provides locking of the slide valve (4) and of the first push-rod (5) in a high position and, consequently, locking of the other push-rod and of the corresponding slide valve in a low position.

2. The device according to claim 1, wherein the return means (R) comprise resilient return means, formed by a spring (22) bearing at one end against the body (2) and at the other end against the push-rod (5), abutment surfaces (24, 25) being provided between the push-rod and the slide valve so as to allow the slide valve to be driven by the push-rod.

3. The device according to claim 1, wherein the recess (g) provided at the periphery of the slide valve (4) is formed by a peripheral clearance forming an annular groove (30;40).

4. The device according to claim 1, in which the slide valve is a regulating slide valve the driving of which is controlled, from the push-rod, through an adjusting spring so that a pressure of the fluid, at an outlet orifice, may be regulated, wherein the outgoing orifice (D) is provided in the axis of the bore (3) of the regulating slide valve (4), which comprises an axial channel (14) opening at one end (15) towards said outgoing orifice (D), said chamber (9) being provided in the body of a distributor and being situated in a direction of the axis of the bore between a zone (21) of the bore where the axial channel (14) emerges and the groove (8) is connected to the pressure intake (P).

5. The device according to claim 1, in which the slide valve is a regulating slide valve the driving of which is controlled, from the push-rod, through an adjustment spring so that a pressure of the fluid, at an outlet orifice, may be regulated, wherein the chamber (9*c*) is provided at an end of the bore (3) in which the slide valve (4*c*) slides, this slide valve comprising an axial channel (14) which is transformed in a zone turned towards the chamber (9*c*) into a cylindrical housing (34) opening towards the chamber and in which a needle (35) is slidingly and sealingly mounted, this needle (35) bearing at one end against the bottom of the chamber (9*c*), a duct (38) being provided in the body (2) between a groove (8) connected to the pressure intake and a bearing zone of the adjustment spring (22) and this duct (38) serving as an outgoing duct.

6. The device according to claim 1, in which the slide valve is a distributing slide valve wherein the chamber (9*c*) is formed at the end of the slide valve (4*d*) opposite the push-rod (5), driving in of the slide valve being controlled by a direct mechanical thrust of the push-rod (5), the recess (g) being formed by an annular peripheral clearance (40) provided at the end of the slide valve (4*d*).

7. The device according to claim 1, which further comprises an automatic locking control comprising an assembly of ducts connecting between the two chambers (9,9*c*) of the slide valves which are diametrically opposite, a passage of the fluid through this assembly of ducts (31) being controlled by a slide valve (33) housed in a duct section of the assembly (31).

8. The device according to claim 7, wherein the slide valve (33) is that of an electro-magnetic valve (32), more especially controlled by an end of travel contact.

9. The device according to claim 1, further including a connecting constriction (e) between each chamber (9*c*) and the reservoir which constriction is formed by a jet (11) mounted in a duct (12) connecting the chambers to a duct (10) leading to the reservoir.

10. The device according to claim 1, wherein the pressurized fluid intake, reservoir return and outgoing orifices are provided on a face of the distributor device, generally a face opposite that adjacent the cam (6).

11. The device according to claim 1, which further comprises a spring (19) housed in a space (20) provided at the end (15) of the slide valve (4) turned towards the outgoing orifice (D), so as to ensure maintenance of the slide valve in a neutral position when the device is unlocked.

* * * * *